United States Patent [19]

Sandoz et al.

[11] Patent Number: 5,058,609

[45] Date of Patent: Oct. 22, 1991

[54] HAIR HIGHLIGHTING APPARATUS

[75] Inventors: William J. Sandoz; Maria A. Sandoz, both of The Ellipse, Ste. 4, Rte. 73 & Church Rd., Mt. Laurel, N.J. 08054

[73] Assignees: William J. Sandoz; Maria A. Sandoz, Delran, New Jersey

[21] Appl. No.: 481,931

[22] Filed: Feb. 20, 1990

[51] Int. Cl.[5] ..... A45D 19/18

[52] U.S. Cl. ..... 132/270

[58] Field of Search ..... 132/270, 220, 221, 222, 132/203, 204, 207, 208

[56] References Cited

U.S. PATENT DOCUMENTS

| | | | |
|---|---|---|---|
| 1,260,744 | 5/1939 | Lewitt | 132/220 |
| 1,656,136 | 1/1928 | Boecklen | 132/222 |
| 2,151,024 | 3/1939 | Gilbert | 132/222 X |
| 2,153,678 | 4/1939 | Reynolds | 132/220 |
| 2,173,269 | 9/1939 | Brown | 132/222 X |
| 3,465,759 | 9/1969 | Haefele | 132/207 |
| 3,548,842 | 12/1970 | McCall | 132/222 |
| 4,190,065 | 2/1980 | Kulpa | 132/220 |
| 4,196,741 | 4/1980 | Minghenelli | 132/222 X |

*Primary Examiner*—Gene Mancene
*Assistant Examiner*—R. Thomas Price
*Attorney, Agent, or Firm*—Norman E. Lehrer; Franklyn Schoenberg

[57] ABSTRACT

A hair highlighting device suitable for use in color treatment of selected strands of hair separated from a head of hair is provided having a sheet of flexible liquid-impermeable sheet and a sheet of non-woven fibrous textile material of a size co-extensive with the sheet of the flexible liquid-impermeable material bonded together. The sheet of non-woven fibrous textile material has releasable self-adhering surface characteristics operative to maintain opposing overfolded contacting surfaces thereof with selected strands of hair interposed therebetween in a liquid sealed relation about the periphery of the selected strands of hair sufficient to prevent seepage of treating fluid therefrom and afford self-supporting frictional engagement during processing of the hair.

11 Claims, 2 Drawing Sheets

HAIR HIGHLIGHTING APPARATUS

FIELD OF THE INVENTION

The present invention relates to apparatus for use in treating hair, and more particularly, to a device for use in color treating selected strands of hair during application of hair treating agents thereto such as in color highlighting or tinting hair and the like.

BACKGROUND OF THE INVENTION

In recent years it has become increasingly popular to treat hair, and particularly women's hair, by coloring or tinting selected strands of hair while separated and isolated from the remaining hair strands. The processes for carrying out such hair treatment are generally termed "highlighting," "tinting," "streaking," "frosting" or the like.

A number of techniques have been developed for such treatment of hair which provide varying degrees of success depending on the skill of the operator and other such factors. The simplest method of bleaching or coloring hair to achieve a contrasting color is hair painting wherein the operator or beautician simply applies a liquid bleach or dye to selected areas of the head of hair to add the desired highlighting. In this method it is generally desired to color or bleach only the uppermost strands of hair. The liquid dye or bleach, however, tends to reach underlying hair, or may even penetrate the entire depth of the hair, which it is not desired to treat and, thus, limits the control needed for achieving the desired results.

Attempts to achieve greater control of the coloring or bleaching process have been suggested including, for example, using pastry chef type bags for applying thickened coloring or bleaching agents to the desired strands of hair or using various devices for isolating selected strands of hair to be treated from the head of hair. A well known technique involves covering the head with a cap having a plurality of apertures through which strands of hair are drawn by means of a hook. The strands of hair which project through the apertures are treated with bleach or dye while the hair remaining under the cap is isolated therefrom and, thus, not treated. After treatment, the cap is removed from the head and drawn away from the treated strands. While this technique is widely used and generally achieves the desired results, it is time consuming, may be uncomfortable for the person wearing the cap and since the bag is not transparent, the operator can not see which strands should be chosen for treatment.

Another widely used process is that known as "foil highlighting" in which a sheet of metal foil, typically aluminum, is used to support selected strands of hair separated from the remaining hair together with the desired bleach, dye or the like treating agent, generally in paste form. After applying the treating agent to the segregated strands of hair, the foil sheet is folded around the treated strands of hair in a manner to form a crimped envelope or package isolating them from adjacent strands of hair while the color treating agent effects the desired color change. The foil envelope is thereafter removed. Normally, a plurality of separate portions of hair are treated in this manner and this aggravates the problem of holding the foil in place, both during application of the treating agent and during processing. Great care and more than one pair of hands are required to hold the plurality of foil sheets in place during the treatment of a head of hair, which problem may become even more difficult when the person is placed under a hair dryer.

More recently, a number of other devices have been developed for use in highlighting hair or the like. For the most part, these devices such as disclosed in U.S. Pat. Nos. 3,800,811; 4,196,741; 4,552,159; 4,637,411 and 4,672,983, enable isolation of selected strands, application of a hair treating agent thereto, and wrapping of the treated strands so as to maintain them isolated from the remaining hair during the treating process.

While the devices disclosed in the prior art may be generally acceptable for the purpose of achieving desired highlighting or the like hair coloring effects, they generally require a substantial number of manual manipulative steps during use which is time consuming, there is a tendency for leakage of the treating agent unless the process is carefully carried out by experienced personnel, and the devices tend to separate from the hair when wet unless separate fasteners are employed, which fasteners further increase the cost and manipulative steps involved in using such device.

It will be apparent that there is a need for a device that is simple and inexpensive to fabricate and which can be reliably used by one person with a minimum number of manipulative steps.

SUMMARY OF THE INVENTION

It is an object of the present invention to provide a simple effective device for use in treating hair to provide color contrast thereto, as in highlighting or tinting, which is simple to use by an operator generally of ordinary skill and is efficient for its intended purpose.

It is another object of the present invention to provide a device for use in treating selected strands of hair, as in highlighting or tinting which employs a pliable sheet of liquid-impermeable material adapted to readily and effectively peripherally retain selected strands of hair in liquid sealed relation with a hair treating composition isolated from the remaining head of hair as well as preventing the selected strands of hair from separating from the sheet of impermeable material during the treating process.

It is yet another object of the present invention to provide a simple, effective device for use in treating selected strands of hair in a head of hair, as in highlighting or tinting, which employs a pliable sheet of liquid-impermeable material having a self-adhering surface adapted to be placed in underlying relation to selected strands of hair during application of a hair coloring or bleaching agent thereto, the sheet being of sufficient length to enable folding over upon itself to substantially overlie the portion underlying the selected strands with the self-adhering surfaces thereof in generally full surface contact and the selected strands of hair between the overlying sheet layers, the self-adhering characteristics of the opposing contacting surfaces of the overlying sheet layers being operative to releasably maintain them in liquid sealed relation peripherally of the strands of hair during the treatment process so as to prevent hair treating agents from leaking or seeping outwardly therefrom and separation of the strands of hair from the overlying sheets.

It is a further object of the present invention to provide a device for use in treating hair to provide color contrast thereto, as in highlighting or tinting, which employs a flexible liquid-impermeable metallic foil adapted to releasably retain selected strands of hair in liquid sealed relation with a hair coloring or dyeing agent isolated from the remaining head of hair during the processing thereof at room temperature and in a hair dryer.

In accordance with the present invention there is provided hair color treating device suitable for use in highlighting and the like of selected strands of hair comprising:

a) a sheet of flexible liquid-impermeable material of sufficient lateral width to extend laterally outwardly from opposite sides of selected strands of hair to be treated;

b) a sheet of non-woven fibrous textile material having self-adhering surface characteristics of a size substantially co-extensive with said sheet of liquid-impermeable material, the self-adhering characteristics of said non-woven textile material being operative t releasably maintain opposing contacting surfaces of overlying sheet layers thereof in liquid sealed relation; and c) an adhesive substantially uniformly bonding said sheet of liquid-impermeable material and said sheet of non-woven textile material together.

Other objects, features and advantages will be readily apparent from the following detailed description of a preferred embodiment thereof taken in conjunction with the drawing.

BRIEF DESCRIPTION OF THE DRAWING

For the purpose of illustrating the invention, there is shown in the accompanying drawing one embodiment which is presently preferred; it being understood that the invention is not intended to be limited to the precise arrangements and instrumentalities shown.

DESCRIPTION OF THE PREFERRED EMBODIMENT

Figure 3:
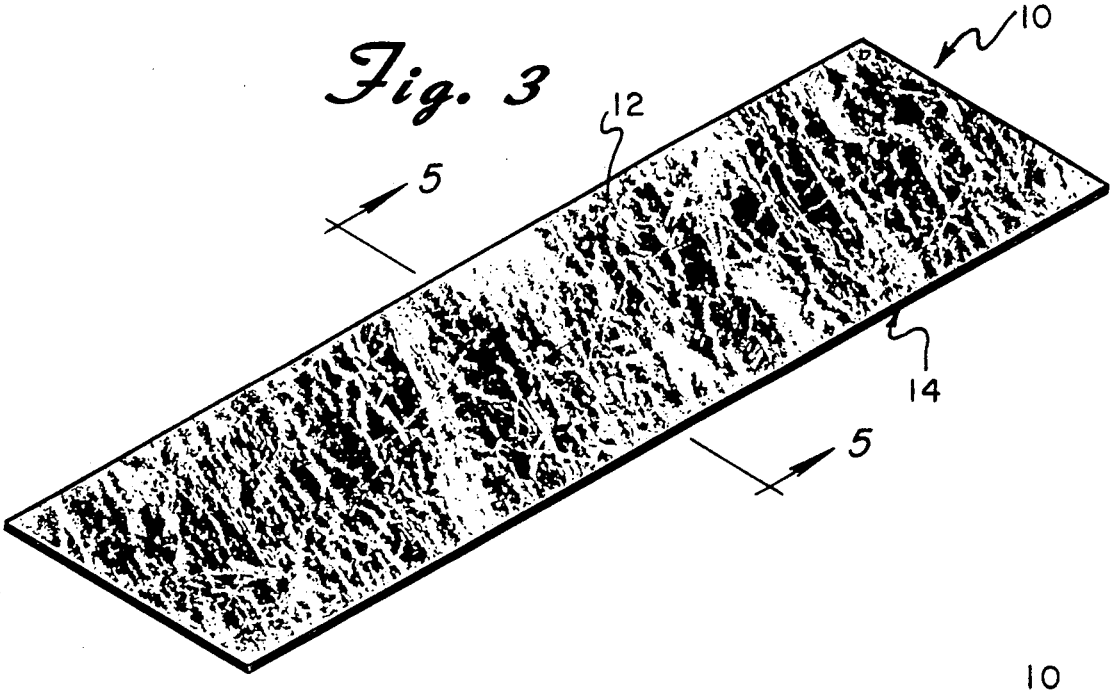
FIG. 3 is perspective view of one side of the hair treating device in accordance with the invention.
Figure 4:
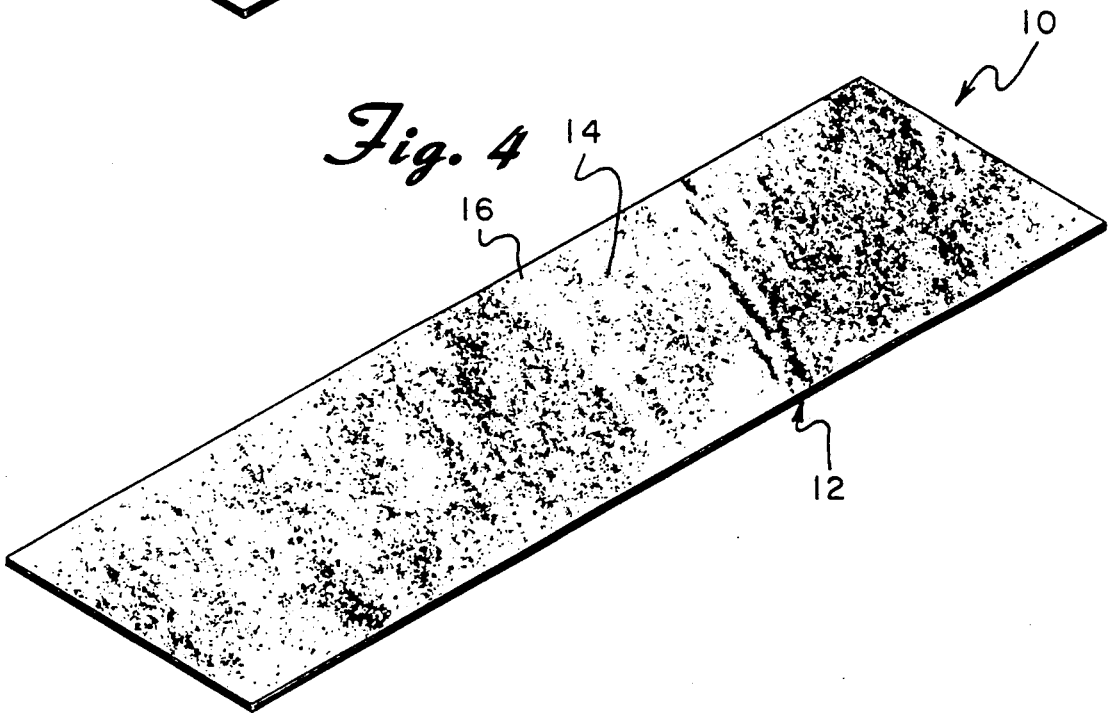
FIG. 4 is a perspective view of the opposite side of the hair treating device of FIG. 3.
Figure 5:
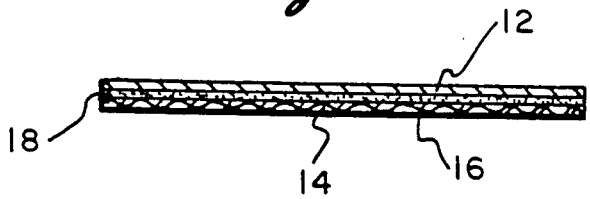
FIG. 5 is a sectional view taken along line 5—5 of FIG. 3.

Referring now to the drawing, where like reference numerals identify like parts, there is illustrated in FIGS. 3 to 5 a hair highlighting apparatus in accordance with the invention shown generally as 10, which includes a pliable or flexible sheet of liquid-impermeable film material 12, a sheet of non-woven permeable fibrous textile material 14 having a surface 16 which exhibits self-adhering characteristics and an adhesive layer 18 uniformly bonding said sheets 12 and 14 together.

The pliable or flexible liquid impermeable sheet 12 is of generally rectangular sheet form or configuration and has a longitudinal length substantially greater than its transverse width, although other configurations may be selected. The impermeable sheet 12 provides the physical barrier to the color treating agent in solution or paste form and thus must be impermeable to such treating agents as well as being chemically resistant thereto. In addition, it must be flexible and tear resistant in thin sheets to facilitate handling with ease and without fear of puncturing or tearing.

A variety of materials can be used to fabricate the impermeable sheet 12 including metallic foil such as aluminum foil, polyolefin plastic film forming materials such as polyethylene, polyvinyl chloride, polyvinyl alcohol or the like, and other plastic or polymeric film materials such as cellophane, cellulose acetate, polyethylene terephthalate, rubber or the like. Preferably, aluminum foil is used in the liquid-impermeable sheet because of its low-permeability, chemical and moisture resistance, reliability, flexibility and tear-resistance in very thin sheets, although any very thin, flexible, liquid-impermeable material that holds a folded configuration would be advantageously employed. While the color of the liquid-impermeable film is not critical, a dark or black outer facing surface may be advantageously employed when it is intended to use a hair dryer during the treating process.

The sheet of non-woven fibrous textile material 14 is to provide a self-adhering material that is operative to maintain opposing contacting surfaces 16 of overlying layers of the hair highlighting apparatus 10 in a liquid sealed relation about the periphery of selected strands of hair and prevent separation or slippage of the strands of the hair interposed therebetween during the treating process. Preferably, the overlying contacting surfaces 16 of the non-woven fibrous material 14 are readily separable when desired without affecting the integrity of the sheet 14. Self bonding of the surface 16 of sheet 14 to the surfaces of other materials is not necessary or even desired. The non-woven fibrous textile material is liquid permeable, somewhat compressible and preferably, absorbent so as to provide a carrier for a hair coloring agent solution and to prevent excess color treating agent from leaking therefrom. While the primary tear resistance of the hair highlighting device of the invention 10 is provided by the liquid-impermeable sheet 12, the fibrous textile sheet material 14 must have sufficient wet strength when saturated to maintain its integrity and self-adhering characteristics.

In general, while the fibrous textile sheet material 14 may be made from a variety of non-woven cellulose textile materials which are non-reactive with the hair treating agent, preferably the sheet is a low density non-woven or felted fibrous cotton sheet which optimizes the self-adhering surface characteristics as well as absorbency, flexibility and strength. The fibrous sheet 14 is, in general, substantially thicker than the liquid-impermeable sheet 12, but it should be thin enough to facilitate folding and bonding requirements yet thick enough (e.g. from about 1/32" to about 1/16") to retain sufficient absorbency of liquid treating agents. The size and configuration of the sheet will be substantially co-extensive with the size and configuration of the liquid-impermeable sheet 12.

The liquid-impermeable sheet 12 and the fibrous textile sheet 14 are uniformly bonded together by a layer of adhesive. The particular adhesive utilized is a matter of choice from the many adhesives commercially available. The guidelines for selecting a satisfactory adhesive are that it must yield uniform bonding in thin layers between fibrous textile material and metallic or plastic film or foil, it must be non-reactive with the hair treating agent or any other agent used during the hair coloring or dying treatment. Preferably, the adhesive should also be non-toxic. The adhesive may be applied by brushing, spraying or the like suitable to provide a thin, uniform coat.

Figure 2:
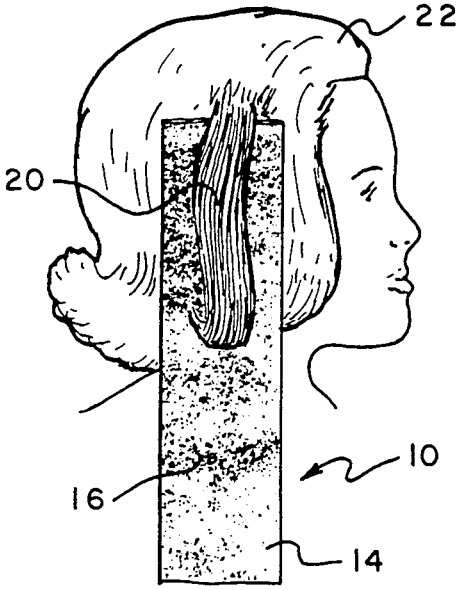
PRIOR ART Fig. 2
FIG. 2 is a side view of a persons head showing a hair treating device in accordance with the invention positioned under the hair to be treated.
Figure 2A:
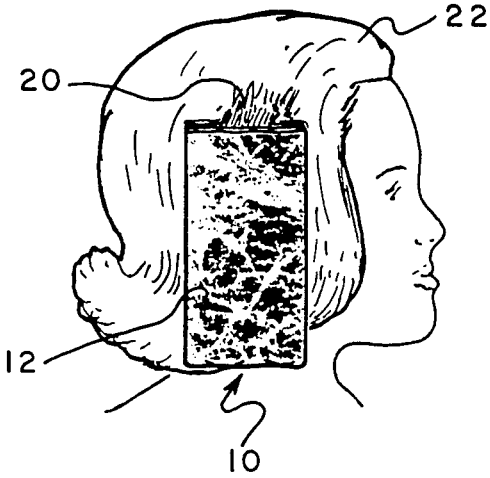
FIG. 2*a* is a side view of the persons head shown in FIG. 2 with the hair treating device of FIG. 2 folded to isolate the strands of hair after application of a hair treating substance and during processing of the hair.

Referring now to FIGS. 2 and 2*a*, there is illustrated one technique for using the hair highlighting device 10 as hereinabove described. The surface 16 of the non-woven fibrous sheet 14 is positioned to underlie the selected hair strands 20 to be treated, as illustrated in FIG. 2, such that the strands lie generally longitudinally along the fibrous sheet 14 on the surface 16 thereof. A suitable hair treating agent, such as a coloring or bleaching solution, may then be applied to the separate strands as by a brush (not shown) or the like. After applying the hair treating agent to the separated hair strands 20, the lower end of the highlighting device 10 is folded upwardly upon itself to a position as illustrated in FIG. 2*a*.

The highlighting device 10 is folded such that the lower free end portion thereof overlies the upper end in juxtaposed relation to the portion of the sheet underlying the separated hair strands 20. The lower folded end of the highlighting device 10 is brought into engagement with the exposed surface 16 underlying the hair strands such that the lateral edge surfaces of the folded lower portion engage the exposed lateral edge surfaces of the upper portion outwardly from opposite sides of the hair strands 20.

As the lower portion of the highlighting device 10 is folded upwardly to overlie the upper portion of the device 10, the folded portion will be substantially co-extensive with the upper portion when brought into engagement therewith. In this manner, the opposed surfaces 16 become bonded by virtue of the self-adhering characteristics of the non-woven fibrous sheet 14 layers. The bonding between the opposing contacting surfaces 16 facilitates substantially full surface releasable adhesion between the non-woven fibrous sheet layers 14 when placed in overlying relation with the selected strands of hair interposed therebetween which is sufficient to thereby maintain the opposed contacting surfaces 16 of the folded device 10 in liquid sealed relation so as to prevent seepage of hair treating agent outwardly from the folded sheet portions, thus isolating the selected hair strands from the head of hair 22. Moreover, the bonding of the opposed contacting surfaces 16 is operative to maintain the overfolded device 10 in self-supporting frictional engagement with the strands of hair 20 interposed therebetween sufficient to prevent separation or even slippage thereof for the time required to complete the hair treating process.

While the embodiment of the hair highlighting device 10 described employs a single integral composite of a flexible liquid-impermeable sheet with a co-extensive sheet of non-woven fibrous textile material bonded thereto, it would be evident that the hair highlighting device may employ separate flexible impermeable sheet/non-woven fibrous sheet composites of substantially the same size. Thus, in an alternate embodiment a first generally rectangular composite having the characteristics as herein described is of a sufficient size to underlie the desired length of selected hair strands. A second similar composite of similar size may be placed into engagement with the exposed surface 16 underlying the hair strands such that the lateral edge surfaces of the second composite engage the exposed lateral edge surfaces of the first composite. In this manner, the opposed surfaces 16 become bonded in liquid sealed relation with the strands of hair interposed therebetween.

Figure 1:
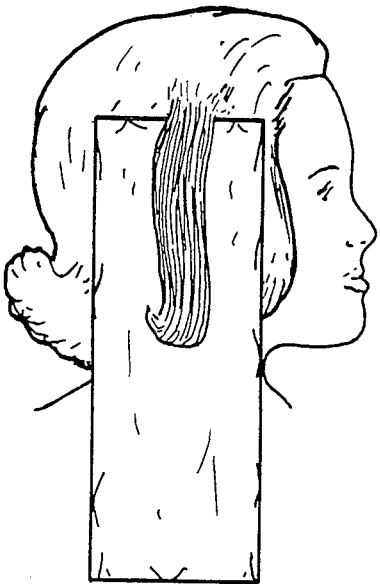
FIG. 1 is a side view of a persons head showing a prior art basic metallic foil hair coloring device positioned in underlying relationship to selected strands of the hair to be treated isolated from the head of hair.
Figure 1A:
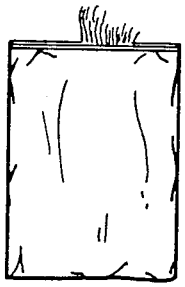
FIG. 1*a* is a fragmentary view of the metallic foil hair coloring device of FIG. 1 with the metallic foil folded in juxtaposition over the portion of metallic foil positioned in underlying relationship to the selected strands of hair to be treated after application of the hair treating agent.
Figure 1B:
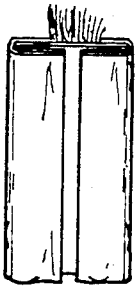
FIG. 1*b* is a view of the metallic foil of FIG. 1*a* with opposite longitudinal edges thereof folded inwardly thereover.
Figure 1C:
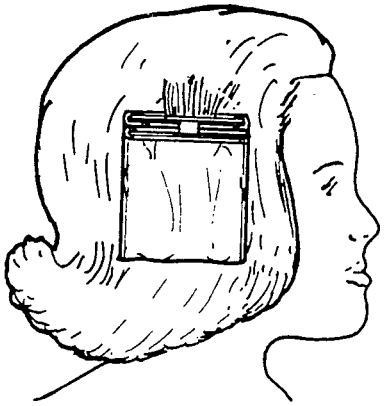
FIG. 1*c* is a side view of the persons head of FIG. 1 showing the prior art basic metallic foil folded in the conventional prior art fashion to envelop selected strands of hair to be treated isolated from the remaining head of hair during processing of the selected strands of hair.

In contrast thereto, the prior art metallic foil device as illustrated in FIGS. 1 to 1*c* depends on multiple manual folding steps to provide an envelope for the selected strands of hair to be treated and there is no bonding between the opposing surfaces thereof either to provide a liquid sealed relation about the periphery of the strands of hair or enhanced frictional engagement between the flexible foil and the strands of hair interposed therebetween.

From the forgoing, it will be apparent that there has been provided by the present invention a hair highlighting device effective for the color treatment of selected strands of hair which is simple and reliable to use even by relatively unskilled operators. The possibility of movement or slippage of the isolating foil has been greatly reduced or even eliminated and the new device can be more economically employed with generally only one operator being needed to achieve the desired results.

Having thus described the invention in relation to the drawings hereof, it will be clear that modifications could be made in the preferred embodiment without departing from the spirit of the invention. Accordingly, it is not intended that the words used to describe the invention be limiting thereof no should the drawings be considered so. It is intended that the invention be limited only by the scope of the appended claims.

What is claimed is:

1. A hair color treating device suitable for use in highlighting and the like of selected strands of hair consisting essentially of:

a) a sheet of flexible liquid-impermeable material of sufficient lateral width to extend laterally outwardly from opposite sides of selected strands of hair to be treated which are isolated from a head of hair;

b) a sheet of non-woven fibrous textile material of a size substantially co-extensive with said sheet of liquid-impermeable material, said sheet of non-woven fibrous textile material having self-adhering surface characteristics which are sufficiently operative to releasably maintain opposing contacting surfaces of sheets of said fibrous textile material in liquid sealed relation; and c) an adhesive substantially uniformly bonding said sheet of liquid-impermeable material and said sheet of non-woven textile material together in substantially co-extensive overlying relationship;

wherein said device is adapted to isolate selected strands of hair from a head of hair during hair highlighting treatment thereof with said selected strands of hair being enclosed between opposing contacting surfaces of overlying sheets of said non-woven fibrous textile material the self-adhering surface characteristics of which are operative to maintain them in liquid sealed relation therebetween during a treatment process with the sheet of liquid-impermeable material serving to provide a liquid-permeable covering therefor.

2. The hair color treating device according to claim 1, wherein said sheet of non-woven fibrous material is a sheet of non-woven fibrous cotton.

3. The hair color treating device according to claim 2, wherein said flexible liquid-impermeable sheet is a metallic foil.

4. The hair color treating device according to claim 1, wherein said flexible liquid-impermeable sheet is aluminum foil.

5. The hair color treating device according to claim 4, wherein said non-woven fibrous material is thicker than said aluminum foil and has absorption characteristics sufficient to act as a hair treating agent carrier.

6. The hair color treating device according to claim 1, wherein said sheet of flexible liquid-impermeable material and said sheet of non-woven fibrous textile material are of a length sufficient to extend outwardly from ends of selected strands of hair isolated from a head of hair by a first end portion of said device with said sheet of non-woven fibrous material underlying the selected strands of hair and to permit a second portion of said device extending beyond the ends of the isolated hair to be folded over and substantially overlie said first portion of said device with said fibrous material in substantially full-surface contact with the self-adhering surface of fibrous material underlying said selected strands of hair.

7. The hair color treating device according to claim 1, wherein the self-adhering surface characteristics of said textile material is sufficient to prevent hair treating agents from leaking outwardly from overlying sheets of said textile material.

8. The hair color treating device according to claim 7, wherein overlying sheets of said textile material form a self-supporting enclosure for said selected strands of hair to be treated.

9. A hair highlighting device suitable for treating selected strands of hair consisting essentially of:

a) a first flexible liquid-impermeable sheet having a self-adhering surface adapted to be placed in underlying relation to selected strands of hair isolated from a head of hair during application of a hair treating agent to the selected strands of hair; and b) a second flexible liquid-impermeable sheet having a self-adhering surface of substantially the same lateral width as said first sheet and of sufficient length to substantially overlie said first sheet in generally full surface contact of the self-adhering surfaces when placed thereagainst with said selected strands interposed therebetween, the self-adhering surfaces of said first and second sheets being sufficiently operative to releasably maintain said sheets in overlying relation through adhesion therebetween and establish a liquid seal about substantially the entire periphery of said selected strands isolated from the head of hair after application of color treating agents therefor.

10. The hair highlighting device according to claim 9, wherein said self-adhering surface of said first flexible liquid-impermeable sheet consisting essentially of a sheet of non-woven fibrous textile material having self-adhering surface characteristics one surface of which is adhered to and substantially co-extensive with said first flexible liquid-impermeable sheet and the self-adhering surface of said second liquid-impermeable sheet consisting essentially of a sheet of non-woven fibrous textile material having self-adhering surface characteristics one surface of which is adhered to and substantially co-extensive with said second flexible liquid-impermeable sheet.

11. The hair highlighting device according to claim 10, wherein overlying sheets of said first and second sheets of material in generally full surface contact of the self-adhering surfaces thereof provides a substantially self-supporting enclosure for said selected strands of hair.

* * * * *